US006170156B1

(12) United States Patent
Lev et al.

(10) Patent No.: US 6,170,156 B1
(45) Date of Patent: Jan. 9, 2001

(54) GEAR TOOTH SMOOTHING AND SHAPING PROCESS

(75) Inventors: Leonid Charles Lev, Birmingham; Anita Miriam Weiner, West Bloomfield; Stephen Joel Harris, Bloomfield, all of MI (US)

(73) Assignee: General Motors Corporation, Detroit, MI (US)

( * ) Notice: Under 35 U.S.C. 154(b), the term of this patent shall be extended for 0 days.

(21) Appl. No.: 09/275,131

(22) Filed: Mar. 24, 1999

(51) Int. Cl.[7] ..... B21D 53/28
(52) U.S. Cl. ..... 29/893.1; 29/90.6; 29/404
(58) Field of Search ..... 29/893.1, 90.6, 29/404; 72/102, 108

(56) References Cited

U.S. PATENT DOCUMENTS 1,989,652 * 1/1935 Drummond ..... 29/90.6
2,147,864 * 2/1939 Thrun ..... 29/90.6
2,423,593 * 7/1947 Gasser ..... 29/90.6
3,606,782 * 9/1971 McNarb et al. ..... 72/108
3,894,418 * 7/1975 Hörl ..... 72/108

FOREIGN PATENT DOCUMENTS 4-147735 * 5/1992 (JP) ..... 72/102

* cited by examiner

*Primary Examiner*—P. W. Echols
(74) *Attorney, Agent, or Firm*—George A. Grove

(57) ABSTRACT

The fatigue life of gears, for example, the gears in a sun gear-planetary gear set, is markedly improved by forming the respective gears by ordinary manufacturing practices and then running each new gear against a durable, but expendable, dummy of its counter-gear. The teeth of a dummy sun gear may be suitably hardened and used under suitable loads to minimally reshape the teeth of a plurality of newly-made pinions so that they are smoothed and better fit an intended sun gear. Similarly, the roughened teeth of a hardened or hard coated sun gear can be smoothed by running it for a few rotations against an expendable pinion.

6 Claims, 2 Drawing Sheets

GEAR TOOTH SMOOTHING AND SHAPING PROCESS

TECHNICAL FIELD

This invention pertains to the manufacture of gears. More specifically, this invention pertains to a new process for smoothing and shaping of gear tooth surfaces. It includes gear run-in or polishing in place for smoothing or re-shaping of tooth surfaces of newly formed gears.

BACKGROUND OF THE INVENTION

Gears have long been used in power transmitting machines and mechanisms to increase or decrease an applied torque or the direction in which a torque is applied. Gears are often formed as wheels, worm wheels or linear racks. Elegant gear manufacturing processes have been developed to form the teeth on the wheel or rack structure.

In the case of gear wheels, the basic gear form with unfinished teeth can be, e.g., cast or forged from a blank of a suitable metal alloy. A hardenable steel, such as AISI 5620, is often a material of choice. Teeth are cut into the circumference of the wheel using a hob or other suitable tool. The surfaces of the hobbed teeth are often then further machine finished or polished so that they are precisely shaped and smooth for good engagement with a counter-gear. Grinding, honing and/or chemical polishing are examples of such gear tooth finishing processes.

In the automotive industry, millions of gears are manufactured each year. In one particularly large manufacturing volume application, e.g., planetary gear sets are commonly used in automatic transaxles. Such planetary gear sets contain at least three main components: a sun gear, a carrier assembly with a plurality of planet pinion gears and an internal gear. The sun gear is located at the center of the planetary gear set and has planet pinion gears revolving around it. These planet pinion gears have gear teeth that are in constant mesh with the sun gear. An internal ring gear encompasses the entire gear set. Torque from the engine (input torque) is transferred to the gear set and forces at least one of these components to rotate. Since all three main components are in constant mesh with each other, the remaining components are often forced to rotate as a reaction to the input torque. After input torque passes through a gear set, it changes to a lower or higher torque value known as output torque. In a front wheel drive automobile transaxle, for example, two such suitably sized gear sets are combined and controlled to provide forward drive ratios and a reverse drive. The output torque from the second gear set then becomes the force that is transmitted to the vehicle's drive axles.

The automobile automatic transaxle is but one example of gear set containing mechanisms that must be carefully designed for minimum cost of manufacture and to sustain high loads over a long product life. The need for continuous improvement in automobile design has required engineers to obtain unreduced or greater output from smaller and lighter robust gear mechanisms.

It is observed that the operating life of a power transmitting mechanism such as an automotive automatic transaxle depends significantly on the fatigue life of the gears. There seem to be two main approaches to increasing the fatigue life of a gear set: improving tooth shape and contact area and increasing the hardness of tooth wear surfaces. The improvement of tooth shape and contact area has been accomplished by expensive machining operations and by unselective natural wear-in or run-in of a newly made and assembled set during the first hours of operation of the mechanism. The increase in the tooth hardness has been accomplished by metallurgical surface hardening, e.g., induction surface hardening of a hardenable steel, or carburization and heat treating of an iron or steel alloy, or by application of a thin coating of hard material such as diamond-like carbon, titanium nitride, boron carbide or the like. While such hardened surfaces increase the fatigue life of a gear set, care must be taken to polish the hard surface or it may cause excessive wear of the mating gear surface by abrasion.

The gear making art requires improvements in the manufacture of suitably shaped gear teeth, and the use of hardened gears, and in the assembly of such gears in a robust power transmission mechanism.

SUMMARY OF THE INVENTION

In a first embodiment, this invention provides an improved method of using a dummy or expendable counter-gear to smooth a hard surface-coated gear before assembly of such gear with an intended counter-gear in a power transmission mechanism. The goal of this smoothing is to remove sharp edges and asperity tips of the hard coating and to reduce the abrasiveness of the coated surface.

In another embodiment of the invention, an expendable hard surface coated counter-gear is used as a low cost and practical tool to run-in and re-shape softer complementary gears before assembly of such gears in a mechanism.

For purposes of illustration, but not limitation, the invention will be described for the case when the changes in the surface of a hard surface-coated sun gear include smoothing, polishing and reduction in its abrasiveness, while the changes in the surface of pinion gears, intended for assembly in a planetary gear set, include polishing and re-shaping.

In one example, an unpolished boron carbide coated sun gear is operated under substantially a design level load and operating temperature against a dummy pinion gear that may be essentially identical to the pinion gears that are to be assembled with the sun gear in a planetary gear set. It is found that a very few rotations of such a sun gear against the expendable pinion smoothes the rough surface asperities of the thin (2–3 micrometers) $B_4C$ coating. The run-in sun gear is then assembled with design specified pinion gears in the design assembly. The dummy pinion is used to smooth more hard-coated sun gears. From the initial operation of the newly assembled mechanism, the run-in sun gear provides the fatigue life benefits of its hardened teeth surfaces without undesirable abrasion of the pinion teeth.

In the converse example of this invention, a suitable sun gear with hard tooth surface is used to reshape pinion gears. After a group of pinions have been formed by a suitable and practical manufacturing process, one or more at a time are rotated at substantially design load and operating temperature against the dummy sun gear with hard tooth surface. The dummy sun gear is suitably identical to the gear designed for assembly with the pinion(s) and a brief rolling operation gives a "final" shape to the pinions prior to their assembly with the sun gear actually made for the machine.

Other objects and advantages of the invention will become more apparent from a detailed description of the invention which follows. Reference will be had to the drawing figures that are described in the following section.

DESCRIPTION OF THE PREFERRED EMBODIMENT

The practice of this invention will be illustrated in the making of sun gears and pinion gears for assembly into a planetary gear set. However, it will be recognized by those skilled in the art that this invention is applicable to the manufacture of many different gear and counter-gear combinations.

Figure 1:
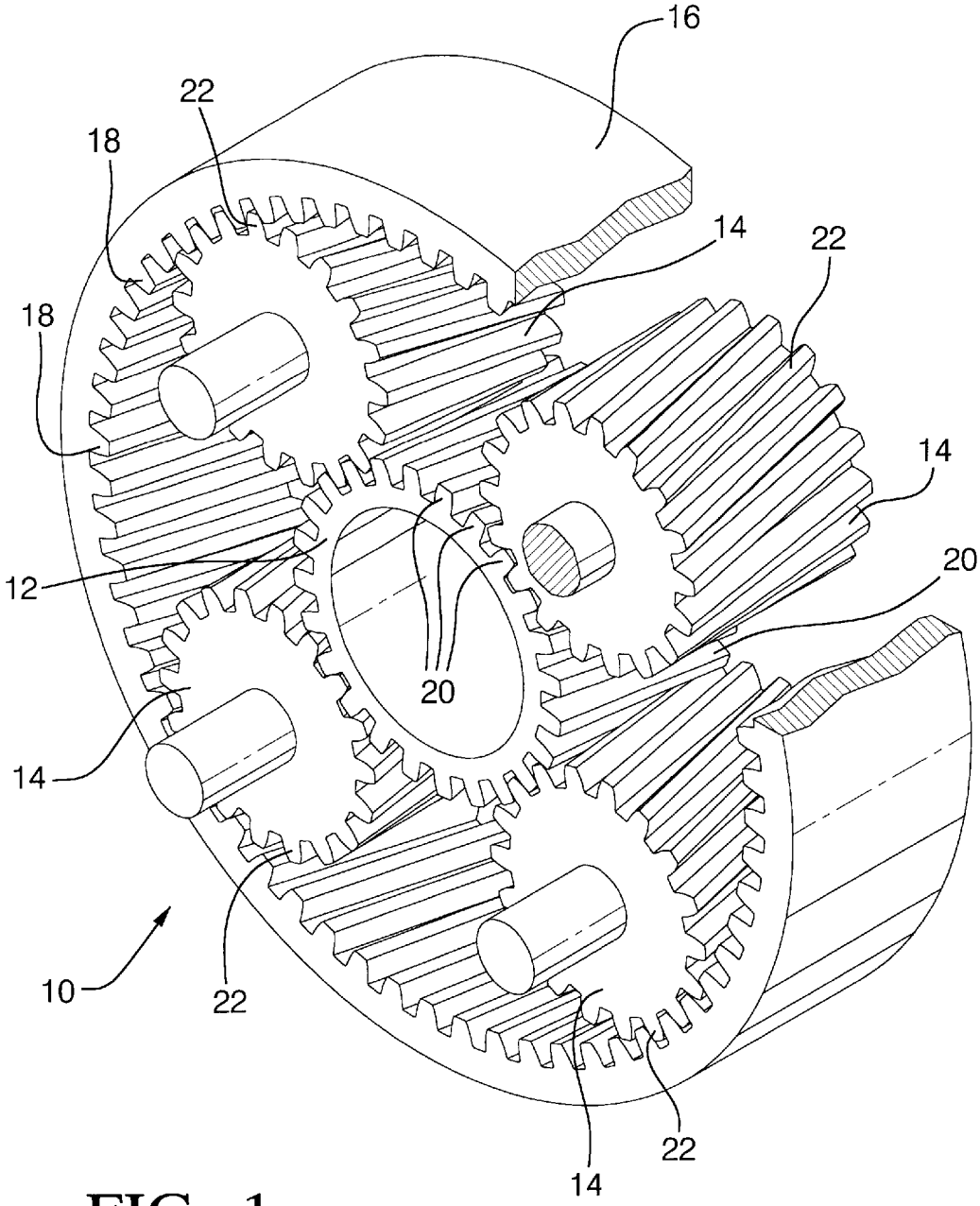
FIG. 1 is a perspective view of an exemplary planetary gear set, components of which can be processed in accordance with this invention.

FIG. 1 is a perspective view of a portion of an illustrative planetary gear set 10. Planetary gear set 10 includes sun gear 12, four planetary gears 14, a planetary gear carrier (not shown) and gear ring 16 with internal gear teeth 18. Gear ring 16 encompasses the entire gear set. Sun gear teeth 20 mesh with the teeth 22 of planetary gears, which in turn mesh with the teeth 18 of the gear ring. Thus, the teeth of the three gear elements must be compatible and intermesh with each other. As illustrated, planetary gears 14 with their teeth 22 are substantially identical. If the sun gear is driven (by means not shown) in a clockwise direction as seen in FIG. 1, the four pinion gears would be driven in a counterclockwise direction. Gear ring 16 may or may not be permitted to rotate, depending on the intended purpose of the mechanism. A planetary gear set like that depicted at 10 often is used in cooperative combination with another gear set in automotive transmission devices.

Since sun gear 12 is often a power input gear and it interacts with four (for example) pinion gears, the surfaces of sun gear teeth 20 are often hardened or provided with a hard coating. When sun gear 12 is made of a hardenable steel, it is often a practice to simply induction harden the surfaces of its teeth 20. In other practices, the sun gear may be formed of a ferrous alloy into which carbon may be introduced by a suitable carburization process so that the surfaces of teeth 20 become carbon enriched and therefore more hardenable. Following the carburization, a suitable heat treatment increases the hardness of teeth 20 of sun gear 12. In still another practice, a suitable hard coating such as a coating of titanium nitride or of boron carbide may be applied by a deposition process to the surface of teeth 20 of sun gear 12. The purpose of such hard coating is to increase the hardness of the tooth surfaces of the sun gear so that it becomes a more durable gear part; that is, it has a greater fatigue life when it is caused to transmit a torque applied to it to a plurality of pinion gears that work in cooperative engagement with it.

The surfaces of hardened teeth 20 of sun gear 12 are often quite rough as formed. The practice of carburizing and heat treating gears often leads to a rough surface. It is also recognized that the application of a thin, hard coating layer to the surfaces of teeth 20 also forms a rough abrasive surface layer that will interact with the usually relatively softer teeth of pinion gears 14.

It is known that the abrasive action of a hard coating on a gear can change the surface morphology of gears against which it rubs. For example, a gear, bearing or other component that is coated with TiN, $B_4C$ or diamond-like carbon (DLC) can polish an uncoated gear or bearing against which it runs (a counterpart). Since the lifetime of these parts is controlled by rolling contact fatigue (RCF) which in turn is strongly affected by the roughness of the parts which rub together, such a polishing action may prolong the life of the coated parts and their counterparts. This mechanism has been proposed to explain why very thin coatings such as TiN, $B_4C$ and DLC can reduce rolling contact fatigue on gears, bearings and other components. On the other hand, a coating which is too abrasive can wear away so much material from a counterpart that the parts no longer function properly. In accordance with this invention, it is proposed that the abrasiveness of a coating be controlled by performing a run-in of a predetermined duration against a dummy counterpart.

It has been found during work on this invention that the rate at which a coating loses its abrasiveness is remarkably high. For example, the abrasiveness of DLC coatings is reduced by at least 60% on each cycle, i.e., one full rotation against a counter-gear. Under some conditions, the abrasiveness can be reduced nearly to zero on a single cycle. The explanation is that abrasiveness is caused by the presence of very sharp asperities, and the tips of these sharp asperities are subjected to the highest possible stresses, which crush them almost immediately. This is illustrated in FIG. 2 as follows.

Figure 2:
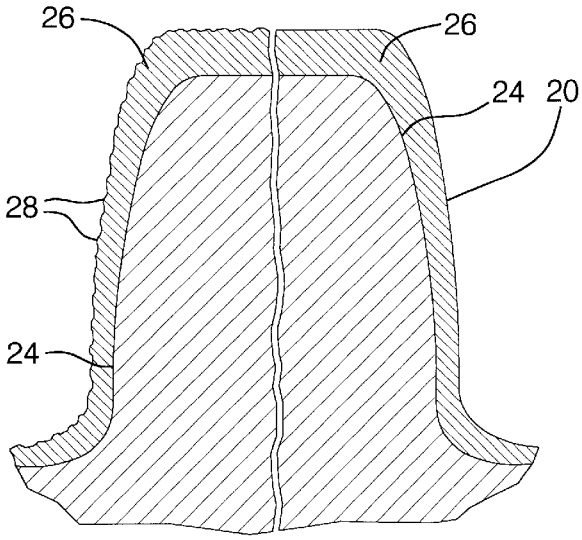
FIG. 2 shows split, greatly enlarged sections of a sun gear tooth illustrated in FIG. 1. The left side of FIG. 2 shows schematically the rough, asperity carrying, as-formed coating of boron carbide on a steel tooth. The right side of FIG. 2 is a schematic view of the tooth after treatment in accordance with the invention.

FIG. 2 shows a split view of a single enlarged tooth 20 of sun gear 12. Sun gear 12 has been formed of a hardened steel alloy AISI 5620 with increased manganese content. A coating 26 of boron carbide ($B_4C$) about three micrometers thick has been deposited on the surface 24 of tooth 20. In the as-deposited form, the surface of coating 26 is characterized by many abrasive asperities 28. Other hard coatings and hardened iron or steel surface layers display rough, abrasive asperity containing surfaces like that depicted schematically in the left half of FIG. 2. If a surface hardened gear is assembled in this as-formed condition with counter-gears, the abrasive surface is very likely to cause unwanted wear of the counter-gear. However, in accordance with this invention, the as-coated or hardened sun gear 12 is run-in over a few rotations (e.g., 1–3 rotations) against a dummy or expendable pinion gear (like pinion 14) and its abrasive surface smoothed so that it appears as illustrated in the right side of FIG. 2. In particular, the rough edges and asperities which would have caused most of the excessive wear on a counterpart are removed.

The result is that the run-in process might well consist of only one or a few cycles, lasting less than one second. A feature of the subject invention is that each hard coated part be run against a dummy uncoated counterpart immediately after coating. This run-in practice is conducted to reduce the abrasiveness of the coating enough to avoid excessive wear of the counterpart while still leaving enough abrasiveness to give the coated part the ability to polish a future counterpart. Thus, in a preferred embodiment, a run-in process is sought for the hardened gear that removes its destructive abrasiveness while leaving its hardened surface capable of performing some useful polishing on the intended softer countergear.

In general, the reduction in the abrasiveness of the coating is proportional to the duration of the run-in process. By varying the duration of the run-in process, the abrasiveness may be adjusted.

To determine a preferred duration of the run-in process, a test may be set up in which a number of coated gears are run-in for different periods of time. The abrasiveness of the coating is then reduced more on gears run-in for longer time than on gears run-in for shorter time. Then each of these run-in gears is meshed with a typical counterpart under the typical conditions (load, speeds, lubrications, temperatures, etc.). One can measure the amount of the polishing of the counterparts and find the optimal amount. The coated gear that produced said amount is therefore run-in to an optimal abrasiveness. Duration of the run-in process applied to this coated gear is optimal and can be replicated for the other coated gears.

As an example of the embodiment of the proposed invention, the use of it as it pertains to coated gears is described. According to one of the methods of production, the gears are hobbed, shaved, carburized and coated with the hard, abrasive coating. In this invention, it is proposed to engage a freshly hardened or coated gear with a second gear, and the two gears are rolled one against another (i.e., run-in) for a time that is sufficient to remove the abrasiveness of the coated gear that would damage countergears intended to engage it. In a preferred embodiment, the duration of the coated gear run-in process is chosen to leave it with the capability to polish the future counterpart but not wear it excessively and is determined as described above. The second gear is a disposable dummy gear, used on a succession of coated gears. As a result of this operation of rolling against the dummy gear, the coated gear loses a predetermined amount of its abrasiveness.

In another embodiment of the invention, an unhardened gear such as a pinion gear 14 is briefly subjected to a run-in process for the purpose of giving the relatively soft gear its final desired configuration before assembly into a gear set. In the absence of expensive machining operations such as honing, final grinding and the like, the shape of a newly manufactured gear is not fully compliant to a countergear; that is, it is not ideally shaped for full conjugated motion with a counter-gear member in applications where they transmit heavy loads. These are possible sources of the imperfections:

1. The surface of the as-machined gears is relatively rough. Stress concentrations develop on the tops of asperities, squeezing the lubricant away. Undesirably small gear tooth areas with metal-to-metal contact may occur, resulting in high friction and accelerated wear.

2. There are inevitable manufacturing errors. For example, some teeth may have positioning errors; the gear axis may be misaligned. Another example of the manufacturing errors could be the deviation of the tooth surfaces from the true involute. Albeit small (of the order of microns or even less), these errors result in some teeth being loaded more and some teeth being loaded less. In similar fashion, some parts of the tooth may be loaded more and some parts of the tooth may be loaded less.

3. Gears and their teeth, as all elastic bodies, change their shape under load. These shape changes are proportional to the load and are similar to or bigger then the manufacturing errors. Although they are supposed to be compensated during manufacturing, it may not always be the case.

Figure 3:
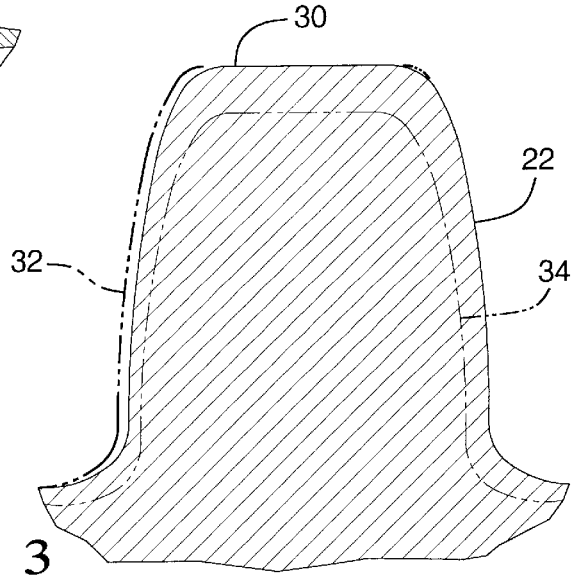
FIG. 3 is an enlarged sectional view of a pinion tooth illustrated in FIG. 1.

In accordance with this invention, a hardened countergear such as the sun gear 12 is employed solely for the purpose of giving softer gears such as pinion gears 14 a final brief shaping operation before the pinion gears are assembled in combination with the actual intended design sun gear. It is found that a relatively few cycles or complete rotations of one or more pinion gears against a hardened sun gear gives the pinion gears a slight final reshaping that better suits their actual compliance for lower stress operation in a finally-assembled gear set. This practice is illustrated schematically with the enlarged tooth portion 22 of pinion gear 14. FIG. 3 is a greatly enlarged section view of a tooth 22, and the dashed line 32 at the left side of the tooth shows the original shape of the tooth. The solid surface 30 with reference line 34 shows a slight change in the configuration of the tooth.

As a result of this re-shaping, asperities, initially protruding above the pinion tooth surface, are worn away. In general, any part of the tooth surface carrying overly high contact load is worn away as well. Hence, this re-shaping affects the distribution of contact stresses: The areas which initially bore high stress will be worn away, creating higher contact area and lower local pressure. Conversely, the areas initially unloaded (at the expense of heavier loaded areas) will be loaded more. Therefore, while the overall load carried by a particular tooth remains approximately the same, the load will be distributed more uniformly. Stress peaks, present originally, will be eliminated.

Figure 4:
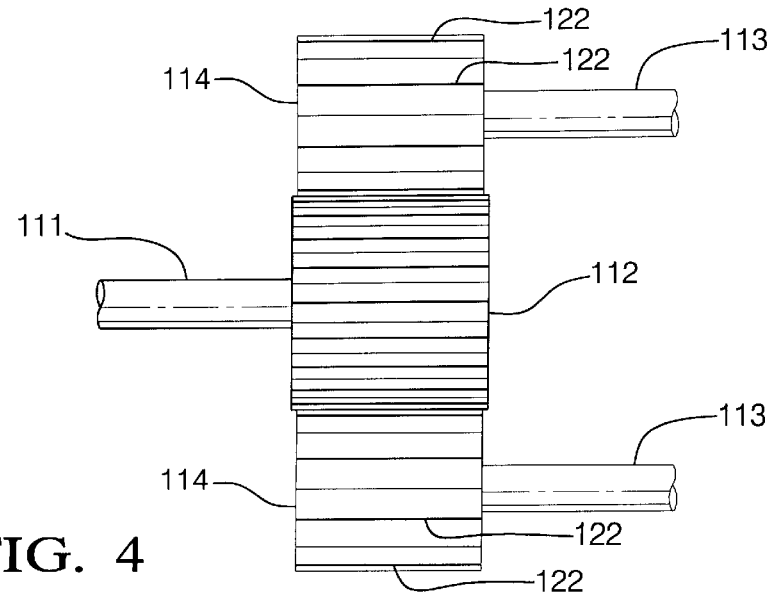
FIG. 4 is a schematic view of an apparatus for running-in sun gears and pinions in accordance with this invention.

The practice of the invention is further illustrated schematically in FIG. 4.

In FIG. 4, a surface hardened gear 112 of identical gear shape and configuration as sun gear 12 is adapted for rotation on a drive shaft 111. Planetary gears 114 which have been newly made and shaped are also temporarily mounted on driven shafts 113. Shafts 113 are rotatable and linearly translatable so that the newly-made pinion gears 114 can be rapidly inserted on them and brought into torque load engagement with the sun gear dummy 112. The gears are rotated together for a few cycles of the pinion gears so that the hard toothed sun gear 112 gives preliminary wear-in shape to pinion gears 114. Following their wear-in process in which their teeth are polished and reshaped, the pinion gears are quickly removed from shafts 113 and new pinions inserted for a like shaping operation. Pinion gears are given final shaping for assembly in a gear set with a design sun gear 12. Of course, design sun gear 12 may have been pretreated against a dummy pinion gear just as pinion gears 114 were pretreated against a dummy sun gear 112.

It is apparent that the apparatus in FIG. 4 is quite schematic. The dummy sun gear 112 would be mounted for extended usage, whereas the driven shafts 113 would be mounted for fast repositioning so that pinion gears 114 may be rapidly placed on the shafts and the shafts moved so that the pinion gears 114 are brought into engagement with the teeth of sun gear 112. Subsequently, the shafts 113 are moved away and the newly-shaped pinion gears removed and replaced with other pinion gears to be processed. It is thus intended that a single dummy sun gear 112 could be employed in the reshaping of many pinion gears 114.

Similarly, where a dummy pinion gear is used to remove the asperities from sun gears, it is intended that a single expendable or sacrificial pinion gear could be employed in the treatment of many sun gears to remove their surface roughness and smooth them for more robust operation in a gear set assembly.

While this invention has been described in terms of some specific embodiments, it will be appreciated that other forms can readily be adapted by one skilled in the art. Accordingly, the scope of this invention is to be considered limited only by the following claims.

What is claimed is:

1. A method of making a gear wheel intended to operate under a power transmitting load in rolling contact against a complementary counter-gear, said gear wheel having evenly spaced teeth formed on a round surface of the gear wheel for said rolling contact, said method comprising forming said gear wheel to an initial shape for assembly in a power transmission device with at least one said counter-gear, rolling said gear wheel under a power transmitting load against an expendable said counter-gear for a period of time sufficient to alter said initial shape of said gear wheel teeth to improve their rolling contact with a said counter-gear, and thereafter assembling the altered gear wheel in a said transmission device with a said counter-gear other than said expendable gear.

2. A method of making a gear wheel as recited in claim 1 comprising:

forming a plurality of said gear wheels, rolling said gear wheels for varying periods against a said expendable countergear to determine a preferred period for altering the initial shapes of said gear wheel teeth and rolling subsequently formed gear wheels for said preferred period.

3. A method of making a sun gear intended to operate in rolling contact against a complementary planetary pinion gear, said sun gear having evenly spaced teeth formed on a round surface for said rolling contact with teeth of a said pinion gear, said method comprising forming said sun gear to an initial shape for assembly in a power transmission device for rolling contact against a plurality of pinion gears, forming a coating, one to four micrometers thick, on the teeth of said sun gear, said coating having a hardness greater than the hardness of the teeth of said pinion gears, said coating being characterized by abrasive asperities, rolling said coated sun gear under a power transmitting load against one or more expendable pinion gears for a period of time sufficient to smoothen said asperities, and thereafter assembling the smoothened sun gear in a said transmission device with said pinion gears other than said expendable gears.

4. A method of making a sun gear as recited in claim 3 comprising:

rolling a plurality of said coated sun gears for varying periods of time to determine a preferred period for smoothing said asperities and thereafter rolling subsequently formed and coated sun gears for said preferred period.

5. A method of making a planetary pinion gear intended to operate in rolling contact against a complementary sun gear, said pinion gear having evenly-spaced teeth formed on a round surface for said rolling contact with teeth of a said sun gear, said method comprising forming said pinion gear to an initial shape for assembly in a power transmission device for rolling contact against a sun gear, rolling a group of said pinion gears under a power transmitting load against an expendable said sun gear with surface hardened teeth for a period of time sufficient to alter the initial shape of the teeth of said pinion gears to improve their rolling contact with the teeth of an operating said sun gear, and thereafter assembling the altered pinion gears in a said transmission device with a said sun gear other than said expendable gear.

6. A method of making a planetary pinion gear as recited in claim 5 comprising:

rolling said pinion gears for varying periods of time to determine a preferred period for altering the initial shapes of said gears and rolling subsequently formed pinion gears for said preferred period.

* * * * *